United States Patent [19]

Sheffield et al.

[11] 4,054,408

[45] Oct. 18, 1977

[54] METHOD FOR OPTIMIZING THE POSITION OF A FURNACE DAMPER WITHOUT FLUE GAS ANALYZERS

[75] Inventors: Robert E. Sheffield; Robert L. Chew, both of Metairie, La.; Charles R. Cutler, Katy, Tex.

[73] Assignee: Shell Oil Company, Houston, Tex.

[21] Appl. No.: 719,031

[22] Filed: Aug. 30, 1976

[51] Int. Cl.[2] ..... F23K 5/00

[52] U.S. Cl. ..... 431/12; 137/4; 431/90

[58] Field of Search ..... 431/2, 8, 12, 90, 89; 236/14, 15 E; 137/467.5, 4

[56] References Cited

U.S. PATENT DOCUMENTS

| | | | |
|---|---|---|---|
| 2,866,602 | 12/1958 | Dailey et al. | 431/12 X |
| 3,049,300 | 8/1962 | Lewis et al. | 431/12 X |
| 3,285,320 | 11/1966 | Clark | 431/12 |
| 3,894,832 | 7/1975 | Chin et al. | 431/12 |

*Primary Examiner*—Edward G. Favors

[57] ABSTRACT

A process for optimizing the combustion of fuel in a furnace wherein the total weight of carbon and hydrogen in the fuel is determined and from the total weight of hydrogen and carbon the air required for combustion can be computed with the air flow to the furnace being adjusted to provide the combustion air plus the desired excess oxygen. The efficiency of the furnace versus excess oxygen is determined and the excess oxygen is varied a small amount on each side of the optimum point obtained from the efficiency versus excess oxygen determination to continuously verify the optimum point.

12 Claims, 2 Drawing Figures

METHOD FOR OPTIMIZING THE POSITION OF A FURNACE DAMPER WITHOUT FLUE GAS ANALYZERS

BACKGROUND OF THE INVENTION

The present invention relates to a method for optimizing the combustion of fuel in a furnace used to heat a fluid. The furnace may be a conventional furnace used for generating steam in a power plant or a heater used to heat process fluids in a refinery or chemical plant. An optimizer controller of this type is illustrated in U.S. Pat. No. 3,184,686. The controller illustrated and described in this patent does not require any stack analysis equipment to derive data for optimizing the combustion process. Instead the controller reduces the excess air to an absolute minimum to achieve optimization of the combustion process. In this respect the controller seeks to find the point on a curve of fuel versus excess air where the fuel flow is minimum. This point is usually not the point of minimum excess air since if too little excess air is used some fuel remains unburned and the combustion process is less efficient. The optimizer allowed the outlet temperature of the fluid being heated in the furnace to control the fuel flow to the furnace and reduced the excess air until the fuel flow increased. When the fuel flow increased, the air flow was increased and then reduced until the fuel flow again increased. Thus, there was a possibility of the furnace smothering when the temperature of the fluid signaled for more fuel flow while the controller was attempting to reduce the excess air below the minimum required for complete combustion. In order to prevent this, the controller incorporated means for rapidly increasing the air flow whenever the excess air was being reduced and the fuel flow was suddenly increased.

In addition, the above controller comprised a separate analog control unit while today numerous refineries and chemical plants have large centralized computer installations. Thus, many of the functions performed by the controller can be provided by the centralized computer. Also, the means by which the controller sought the optimum excess air flow provided a rather erratic control with a possibility of smothering the furnace with an excess fuel flow.

Further, the system disclosed in the patent made no provision for controlling the air flow in relation to the fuel flow. Instead the patent attempted to reduce the air flow at a relatively slow rate while permitting the fuel flow to vary in response to the load on the furnace. If a point was reached where the fuel flow increased the system assumed this was due to incomplete combustion and increased the air flow at a rapid rate. While this type of optimization was successful under substantially steady state conditions, it will not respond to varying fuel flows caused by varying loads on the furnace. Likewise, the system also will not respond when a furnace is burning various amounts of different types of fuels. For example, in refineries, as natural gas becomes more scarce, more fuel oil is being burned in heaters. While fuel oil may be the main source of fuel, considerable gas is still burned especially gas produced as a by-product in various processes in the refinery. Thus, the optimization control must be capable of handling various amounts of different fuels while still optimizing the combustion process.

BRIEF SUMMARY OF THE INVENTION

The present invention solves the above deficiencies in the prior patented process by first determining the air flow through the furnace with relation to the position of a control damper. Normally, the control means will be a damper in the stack or outlet of a furnace whose position can be varied to vary the air flow through the furnace although other means such as varying the speed of a blower may also be used. The system measures the fuel flow and the density of the fuel and uses this information to convert the fuel flow to total weights of carbon and hydrogen in the fuel. Using the weights of carbon and hydrogen in the fuel the system determines the amount of air required to burn the fuel while the amount of excess air is determined from the desired amount of excess oxygen. The total of the air required to burn the fuel plus excess air is used to position the damper to obtain the desired air flow.

The system also includes means for calculating optimum excess oxygen by determining the reciprocal of the efficiency of the furnace. The reciprocal of efficiency is defined as the heat released in the furnace divided by the product of total fluid flow times the temperature increase in the fluid. The calculated reciprocal efficiency can be plotted with respect to excess oxygen to obtain a second order curve from which the optimum excess oxygen can be determined. The optimum excess oxygen can also be obtained by using a second order least squares fit of the calculated reciprocal efficiency with respect to excess oxygen. Once the optimum excess oxygen is determined, the least squares fit will produce a cluster of closely spaced points. This will make it difficult to determine the true shape of the efficiency versus excess oxygen curve. In order to obtain a greater spread of points, the excess oxygen may be varied in a direction to increase the excess oxygen by 0.5% of the total stack gas flow for one hour, returned to the calculated point for the next hour and then decreased by 0.5% of the total stack gas flow for the succeeding hour. In this manner, the system will continually adjust the excess oxygen in the furnace to obtain an optimum position. In addition, the efficiency can be calculated on a set time interval and the hourly average stored to give a background history. For example, 24 hours could be stored with one hour being dropped as each additional hour's calculation is added. To prevent the efficiency calculation from determining air flow levels which would produce smothering in the furnace, reference points can be introduced into the calculations. For example, reference points for high and low air flows will bias the efficiency calculations so that it stays within these limits.

BRIEF DESCRIPTION OF THE DRAWINGS

The present invention will be more easily understood from the following detailed description of a preferred embodiment when taken in conjunction with the attached drawings, in which.

PREFERRED EMBODIMENT

Figure 1:
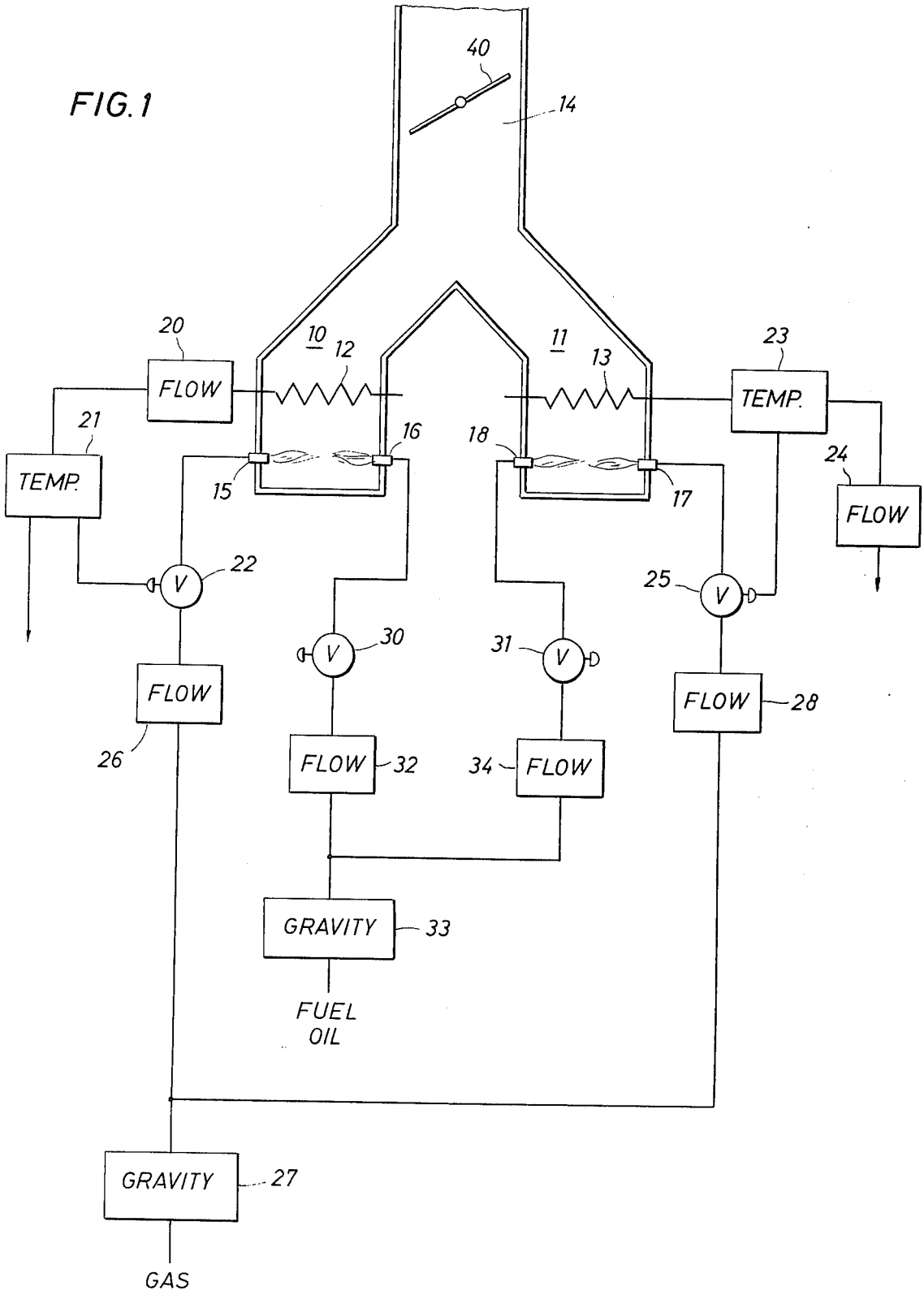
FIG. 1 is a schematic representation of a furnace having two heating cells coupled to a single stack and a single damper to control air flow.

Referring now to FIG. 1, there is shown a typical refinery furnace installation having two separate cells 10 and 11 for heating process streams 12 and 13. Both cells are coupled to a single stack 14 having a damper 40 to control the air flow. Each cell is provided with separate burning equipment 15 and 17 for burning natural gas and 16 and 18 for burning fuel oil. The temperature and flow of the fluid in the cell 10 is measured by suitable instruments 20 and 21 with the temperature measuring instrument 21 controlling the position of a valve 22 in the gas flow line. In addition, the gas flow and its gravity is measured by means of suitable instruments 26 and 27. In a like manner the temperature and flow rate of the fluid in the cell 11 is measured by instruments 23 and 24 with the temperature instrument 23 controlling the position of the valve 25 to control the gas flow to the cell 11. The flow rate of the gas is measured by instrument 28. The fuel oil supplied to each cell is controlled by valves 30 and 31, respectively with these valves being manually set in a position where the combination of the fuel oil supplied to the cell plus the variable gas flow will supply the heat demand for the cell. Normally, sufficient natural gas will be available to control the load changes on the cell without requiring any change in the fuel oil flow. The fuel oil flow to each cell is monitored by instruments 32 and 34 while its gravity is monitored by instrument 33.

The composition of natural gas or fuel oil is closely related to its gravity so that gravity measurements can be used to determine the hydrogen and carbon content of the fuels. This permits the optimizing system to handle any type of gas or fuel oil supplied to the furnace which is important in the case of a refinery where in the case of an upset various product streams may be diverted to the furnace fuel system. Product streams can be diverted when they are off specification or in the case of an upset in the plant which requires the disposal of large quantities of the product. Obviously, it is much preferred to burn the product in a furnace in a refinery than to burn it in a flare stack from which there would be no recovery.

The weight fraction of carbon per volume of gas can be expressed by the following formula:

$$C_g = K_1 + K_2 . \text{Fuel Gas Gravity} - K_3 . (\text{Fuel Gas Gravity})^2 + K_4 . (\text{Fuel Gas Gravity})^3$$

Similarly, the ratio of carbon to hydrogen in the fuel oil can be expressed as follows:

$$C_f/H_f = K_1 - K_2 . \text{Fuel Oil Gravity} + K_3 . \text{Fuel Oil Gravity}^2$$

Likewise, the carbon in the fuel oil can be related to the ratio of carbon to hydrogen in the fuel oil by the following formula:

$$C_f = (C_f/H_f C_f/H_f + 1)$$

Using the measured flow to each furnace and the above formulas, it is possible to determine the weight of carbon and weight of hydrogen in the fuel supplied to furnaces. In addition to the measured fuel gas flow a feed forward control for the dampers is provided by utilizing the signals used to position the gas flow valves 22 and 28. The use of a feed forward control allows the damper to react at the same time that the fuel gas flow is changed instead of lagging. If a feed forward control were not used, the analog temperature controller would continuously reposition the fuel flows to control the furnace outlet temperature. This would result in the damper not reacting to a change in the fuel flow and if the flow were increased rapidly the possibility of smothering the furnace would arise. The expected fuel gas flow to each cell can be calculated as follows: Fuel Gas Flow = Measured Fuel Gas Flow + (Signaled Change in Valve Position . Conversion Factor)

The conversion factor converts the signaled valve movement to gas flow in MMSCF.

Using the calculated gas flow the weight of the gas flow and oil flow can be determined as follows:

Weight of Fuel Gas ($W_g$) = K (Gas Flow . Gas Gravity)

Weight of Fuel Oil ($W_f$) = K (Fuel Oil Flow. Fuel Oil Gravity)

Weight of Carbon ($C_w$) = $W_g . C_g + W_f . C_f$

Weight of Hydrogen ($H_w$) = $W_g(1 - C_g) + W_f(1 - C_f)$

The weight of carbon ($C_w$) and weight of hydrogen ($H_w$) can be converted to moles by dividing by their respective molecular weights 12.011 and 2.016 as follows:

Weight of Carbon in Moles ($C_m$) = $C_w/12.011$

Weight of Hydrogen in Moles ($H_m$) = $H_w/2.016$

Within the above information for the weight of hydrogen and carbon in the fuel, it is possible to determine the amount of air required from the following relationships:

The air required for the above weight of fuel can be calculated as follows where $O_2$ equals desired oxygen in the stack in mole percent:

$$A_1 = C_m + H_m/2 + [O_2/(100-O_2)] . (C_m + H_m)$$

$$A_2 = K - K . \text{Humidity of Air } (A_n)$$

$$A_3 = [O_2/(100 - O_2)] . (K . A_h + K)$$

Total Air ($A_t$) = $A_1 / [A_2 - A_3]$

The damper position for the furnace can be determined by the following:

$$\text{Damper position} = (K_1 - A_{t/K2}$$

in which $A_t$ is the total air flow through both cells of the furnace. The two constants $K_1$ and $K_2$ in the above equation must be determined from actual tests of the furnaces. The tests determine the air flow in the furnace versus damper position. This relationship will be a straight line over the range of damper positions of 50 to 90 percent closed and if the cells are the same size and have similar characteristics the air flows in each will be substantially the same.

The optimum oxygen content of the stack gases is determined by calculating the reciprocal of efficiency of each furnace which is defined as follows:

$$\text{EFF} = \text{HR/FLOW} . \text{DELTAT}$$

in which

HR = The heat released in the furnace in MMBTU/Hr

FLOW = The flow through the heat exchanger of the furnace in MB/Hr; and

DELTAT = The temperature increase in the flow through the furnace in °F.

Theoretically, the above equation for efficiency will provide a series of points which would produce a second order curve if the reciprocal efficiency is plotted as a function of desired oxygen content. The curve will have a minimum at the optimum oxygen level and thus, the optimization of the oxygen content can be achieved by locating the minimum point on the curve.

The optimization is achieved by calculating a second order least squares curve fit of the reciprocal efficiency versus oxygen content data based on information that is collected over the previous 24 hours of furnace operation. A new optimum oxygen content and a new reciprocal efficiency versus oxygen data pair are determined once each hour with each hourly calculation being the average of 30 individual calculations performed every two minutes. The desired oxygen content in the stack is held constant for each hour to produce reliable data for determining the optimum oxygen content of the stack gas. In order to generate sufficient data to provide meaningful data points, the desired oxygen content is stepped about the calculated optimum in a four-hour cycle. In each four-hour cycle, the desired oxygen content will be varied 0.5% of the total stack gas flow on each side of the optimum for 1 hour and will equal the optimum for two hours (i.e., 2.5%; 2.0%; 2.5%; and 3.0% of the total stack gas flow where 2.5% of the total stack gas flow is the optimum excess oxygen). The efficiency is calculated every two minutes and the hourly average stored, while the optimum excess oxygen is based on the previous 24 hours of stored efficiency calculations.

The oxygen optimization calculations are performed for each cell. This will yield two desired oxygen levels, one for each cell, and since there is only one damper to control the air flow in both cells only one of the optimums can be used in the damper positioning calculations. Thus, the optimum chosen is the higher of the two values which produces the optimum combustion in one cell while resulting in a slight excess air flow in the other cell. Of course, in a multicell furnace the individual cells are designed substantially equal and the process is controlled so that the heat release in each cell is substantially equal.

In order to prevent the oxygen optimization calculation from producing unreasonable oxygen levels which would produce smothering in the furnace or a large amount of excess oxygen in the stack, reference points that effect the maximum and minimum excess oxygen are introduced into the calculated reciprocal efficiency-oxygen data points. The two sets of reference points are chosen at desired levels, for example, an oxygen content equal to 1% and a reciprocal efficiency equal to 4 and at an oxygen content equal to 5% and a reciprocal efficiency equal to 4. Thus, the reference points in effect place limits on the oxygen efficiency calculation. The influence of the reference points is controlled by a multiplying factor which is applied to the least squares sums of the 24 reference points before they are combined with the calculated 24-hour sums for the least squares fit. This variable can vary over a wide range, from actual operation, it has been determined that a range of 0.05 to 0.10 for the multiplying factor for the reference points is adequate. This in effect introduces 2 to 4 reference points per 1,000 observations of the oxygen efficiency parameters.

Figure 2:
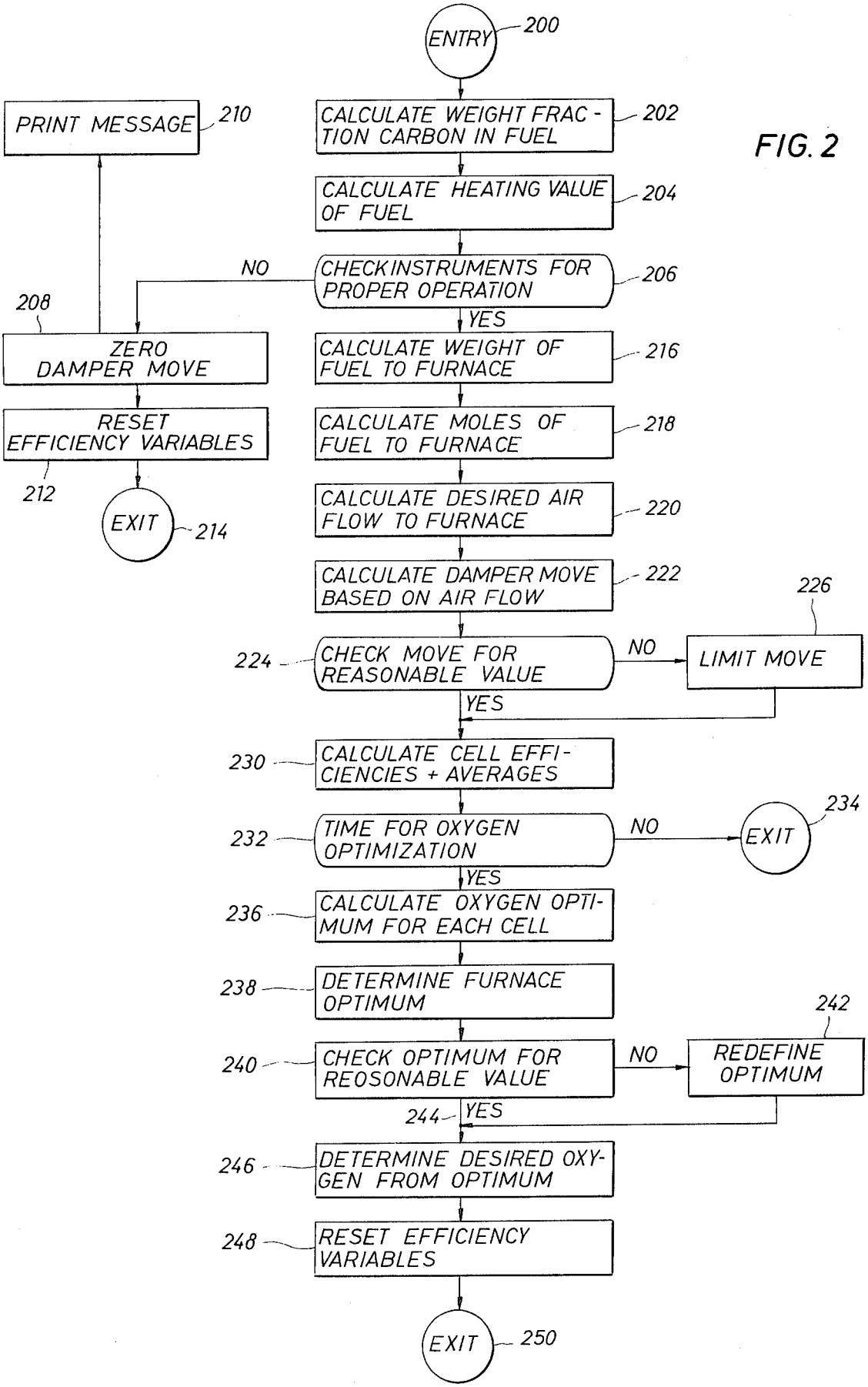
FIG. 2 is a flow diagram of a computer program for carrying out the method of this invention.

Referring now to FIG. 2, there is shown a flow sheet for programming a suitable general purpose digital computer to carry out the calculations required by the above described optimization process. The preparation of an appropriate program for carrying out the functions set forth in the flow diagram can be accomplished by those skilled in the art with reference to numerous well known texts on computer programming. For example, a General Electric digital computer known as a GE Model 4020 computer can be programmed using a Fortran language as described in many available texts.

The program is entered at 200 and passes to an operational box 202 where the weight fraction of carbon in fuel is calculated. The fuel gas gravity from the transducer 27 and the fuel oil gravity from the transducer 33 are inputs to the box 202 and used to determine the weight fraction of carbon in both the fuel gas and fuel oil. After the carbon in fuel is calculated, the heat values of the fuel gas an fuel oil are determined using the same inputs as box 202. The heat value of the fuel is of course necessary to calculate the furnace efficiency in optimizing the oxygen content of the stack gas as described above. An additional check is made as indicated in the box 206 to insure that all of the instruments are operating properly. If the check determines that the instruments are not operating then the program does not proceed but instead a message is printed out in the box 210 to indicate the malfunction and that the program is no longer controlling the damper position. This would alert the operator that he must manually control the damper until the necessary corrections are made to the instruments. The box 208 also provides zero damper movement by the program and in addition, passes data to an operation box 212 which reinitializes the variables associated with the oxygen optimization calculations. This is of course necessary to insure that the averages used in the efficiency data calculations are obtained from values determined from successive program runs. The program then exits through box 214 to be stored on an appropriate memory.

If the system indicates that all instruments are performing properly, the program proceeds to the box 216 where the weight of the fuel supplied to the furnace is calculated using the weight of carbon and hydrogen determinations plus the fuel flows indicated by the transducers 26, 28, 32 and 34 and the feed forward fuel moves. The weight of fuel is converted to moles of fuel by the box 218 which data is then supplied to the box 220 where the desired air flow to the furnace is computed. The air flow is computed using the moles of carbon and hydrogen in the fuel, the humidity of the air and the desired oxygen content of the stack gases.

Once the desired air flow is calculated the damper position can be calculated based on the air flow by the box 202. As explained above in order to calculate damper position to achieve the desired air flow tests must be run on the furnaces to accumulate data for air flow versus damper position. This data of course can be stored in the computer and used in calculating the proper damper position. The box 222 sends a single to the damper controller which is the difference between the desired position of the damper and its present position. Prior to sending a signal to the damper controller, the desired change in damper position is checked by the box 224 to see if it is a reasonable value. This is done by supplying the desired change to a box 226 which is provided with maximum allowable moves of the damper. If the desired moves are within the maximum allowable moves, the program proceeds to the box 230. If the desired moves are not within the allowable maximums, the allowable maximums are sent to the box 230. The box 230 in succeeding steps of the program is used to calculate the optimization of the system. The first step is, of course, to calculate the efficiency of each cell which is then sent to the optimum calculation cell 236 if it is time for an oxygen optimization. If it is not time, the data is stored by exiting through box 234 to accumulate it for the averaging when time for calculating the oxygen optimum for each furnace arrives. If it is time to calculate the oxygen optimum for each furnace, the data is supplied to the box 236 which signals the box 238 to determine the furnace optimum. Again, the determined optimum is checked to see if it is reasonable value and if it is, the program proceeds to the box 246 where one determines the desired oxygen for optimization.

We claim as our invention:

1. A process for optimizing the combustion of fuel in a furnace comprising:

measuring the fuel flow to the furnace per unit of time;

measuring the density of the fuel;

using the measured fuel flow and density to convert the fuel flow to the total weight of carbon and hydrogen supplied to the furnace per unit of time;

calculating the air flow required per unit of time for combusting the total weight of carbon and hydrogen plus the additional air flow required for excess oxygen; and adjusting the air flow to the furnace in response to the calculated air flow.

2. The optimizing process of claim 1 and, in addition, computing an efficiency factor of the combustion by dividing the heat released in the furnace by the fluid flow through the furnace times the temperature increase and calculating an efficiency factor versus excess oxygen curve by varying said excess oxygen to obtain an optimum percentage of excess oxygen.

3. The optimizing process of claim 2 and, in addition, varying the excess oxygen a predetermined amount on each side of said optimum percentage at regular intervals.

4. The optimizing process of claim 3 and, in addition, varying the excess oxygen over a range of plus 0.5 percent to minus 0.5 percent of the total stack gas flow on each side of the optimum amount obtained from the plot of efficiency versus excess oxygen.

5. A process for optimizing the combustion of fuel in a furnace wherein at least two different fuels are burned simultaneously in the furnace, said process comprising:

measuring the flow of each fuel;

measuring the density of each fuel;

using the measured flow and density of each fuel to compute the total weight of hydrogen and carbon contained in each fuel;

combining the weight of hydrogen and carbon for each fuel to obtain the total weight of hydrogen and carbon supplied to the furnace;

determining the amount of air required to burn the total weight of hydrogen and carbon supplied to the furnace plus the desired excess oxygen; and controlling the air flow to the furnace to supply the required air plus recess oxygen.

6. The process of claim 5, and in addition, determining the reciprocal of efficiency for the furnace at spaced time intervals to obtain the optimum amount of excess oxygen required for maximum efficiency.

7. The process of claim 6, and in addition, varying the amount of excess oxygen above and below the optimum amount of excess oxygen required for maximum efficiency to verify the amount required for maximum efficiency.

8. The process of claim 7 wherein variation in the amount of excess oxygen is limited to 0.5 percent of the total stack gas flow above and below the optimum amount of excess oxygen.

9. The process of claim 6 wherein the optimum amount of excess oxygen determinations were stored for a fixed time interval.

10. The process of claim 9 wherein the oldest determination is dropped as each new determination is added.

11. The process of claim 10 wherein the determinations are stored for a 24-hour period.

12. The process of claim 9 wherein reference points are included in the stored determinations to prevent smothering of the furnace and large quantities of excess oxygen.

* * * * *

UNITED STATES PATENT OFFICE

CERTIFICATE OF CORRECTION

PATENT NO. : 4,054,408

DATED : October 18, 1977

INVENTOR(S) : Robert E. Sheffield; Robert L. Chew; and Charles R. Cutler

It is certified that error appears in the above-identified patent and that said Letters Patent are hereby corrected as shown below:

Column 3, line 55, reading $C_f = (C_f/H_f\ C_f/H_f + 1)$ should read:
$C_f = [C_f/H_f/(C_f/H_f + 1)]$ Column 4, line 33, reading $A_n$ should read: $A_h$ Column 4, line 40, reading Damper Position = $(K_1-A_{t/K_2}$ should read: Damper Position = $(K_1-A_t)/K_2$ Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*